US008104437B2

(12) United States Patent
Rabhi

(10) Patent No.: US 8,104,437 B2
(45) Date of Patent: Jan. 31, 2012

(54) ELECTROMECHANICAL DEVICE FOR CONTROLLING A VARIABLE COMPRESSION RATIO ENGINE

(76) Inventor: Vianney Rabhi, Lyons (FR)

( * ) Notice: Subject to any disclaimer, the term of this patent is extended or adjusted under 35 U.S.C. 154(b) by 546 days.

(21) Appl. No.: 12/160,212

(22) PCT Filed: Jan. 26, 2007

(86) PCT No.: PCT/FR2007/000147

§ 371 (c)(1),
(2), (4) Date: Dec. 29, 2008

(87) PCT Pub. No.: WO2007/085737

PCT Pub. Date: Aug. 2, 2007

(65) Prior Publication Data

US 2009/0266337 A1 Oct. 29, 2009

Related U.S. Application Data

(60) Provisional application No. 60/762,904, filed on Jan. 30, 2006.

(30) Foreign Application Priority Data

Jan. 26, 2006 (FR) ..... 06 00708

(51) Int. Cl.
*F02B 75/04* (2006.01)

(52) U.S. Cl. ..... 123/48 B

(58) Field of Classification Search ..... 123/78 A, 123/197.3, 48 B, 48 R, 78 R; *F02B 75/04*
See application file for complete search history.

(56) References Cited

U.S. PATENT DOCUMENTS

| | | | | |
|---|---|---|---|---|
| 4,202,300 | A * | 5/1980 | Skay | 123/432 |
| 5,406,911 | A | 4/1995 | Hefley et al. | |
| 6,354,252 | B1 * | 3/2002 | Rabhi | 123/78 BA |
| 2008/0017023 | A1 | 1/2008 | Rabhi | |

FOREIGN PATENT DOCUMENTS

| | | |
|---|---|---|
| EP | 0 634 319 A2 | 1/1995 |
| WO | 2005/098219 A1 | 10/2005 |

* cited by examiner

*Primary Examiner* — Michael Cuff
*Assistant Examiner* — Keith Coleman
(74) *Attorney, Agent, or Firm* — Young & Thompson

(57) ABSTRACT

An electromechanical device (800) which can be used to control the compression ratio of a variable compression ratio engine, includes mechanical elements for transmitting movement (801) between at least one electric engine (802) and at least one control rod (20) of a control jack (8) of a control device (12) for adjusting the vertical position of a control rack (7) of the variable compression ratio engine.

30 Claims, 5 Drawing Sheets

ELECTROMECHANICAL DEVICE FOR CONTROLLING A VARIABLE COMPRESSION RATIO ENGINE

The present invention relates to an electromechanical device permitting the compression ratio of a variable compression ratio engine to be controlled.

According to the international patents WO98/51911, WO00/31377, WO03/008783 belonging to the applicant, different mechanical devices are known for a variable compression ratio engine.

It is observed that the international patent WO/98/51911 in the name of the applicant discloses a device used for improving the overall efficiency of internal combustion piston engines used at variable load and engine speed by adapting the effective capacity and/or the compression ratio thereof during operation.

It is observed that, according to the international patents WO0/31377 and WO03/008783 in the name of the applicant, the mechanical transmission device for a variable compression ratio engine comprises at least one cylinder in which a piston is displaced which is integral, in its lower portion, with a transmission member cooperating on the one hand by means of a small-sized rack with a roller bearing guide device and on the other hand by means of a further large-sized rack with a sprocket wheel fixed to a connecting rod, said connecting rod making it possible to transmit the movement between said piston and said connecting rod.

The mechanical transmission device for a variable compression ratio engine also comprises at least one control rack cooperating with the sprocket wheel, means for fixing the piston to the transmission member which provide a preload for clamping, connecting means which make it possible to rigidify the teeth of the racks and means for reinforcing and lightening the structure of the sprocket wheel.

It is observed that the vertical position of the control rack of the engine determines the compression ratio of said engine.

Maintaining said control rack in a vertical position and the displacement thereof into a different vertical position are provided by a control actuator.

The actuator comprises a lower chamber and an upper chamber of which the capacity is kept identical to that of said lower chamber due to an actuator rod extender also known as the upper actuator rod.

The control actuator also comprises an actuator piston, valves held in place by springs and a control rod. The upper end of said actuator is closed by a cylinder head.

It is noted that, according to the international patent WO98/51911 in the name of the applicant, the vertical position of the control rod may be modified by low-powered electrical means which may communicate to said control rod a vertical translation movement making it possible to open or close the valves of the control actuator so that it is positioned automatically in the same vertical position as that of the control rod.

It is noted that the different patents in the name of the applicant do not disclose any solution which makes it possible to transmit effort generated by the low-powered electrical means to the control rod(s) of the variable compression ratio engine to control the vertical position thereof.

It is to allow the implementation of transmission means between the low-powered electrical means and the control rod(s) of a variable compression ratio engine that the invention comprises, according to a particular embodiment, an electromechanical device permitting the compression ratio of a variable compression ratio engine to be controlled.

The electromechanical device according to the present invention comprises mechanical means for transmitting the movement between at least one electric motor and at least one control rod of a control actuator of a control device making it possible to control the vertical position of a control rack of said variable compression ratio engine.

The electromechanical device according to the present invention comprises mechanical means for transmitting the movement between at least one electric motor and at least one control rod which consist of at least one camshaft which comprises at least one cam.

The electromechanical device according to the present invention comprises a camshaft which is positioned above the cylinder head of the control actuator(s) of the engine.

The electromechanical device according to the present invention comprises a camshaft which is positioned below the control actuator(s) of the engine, inside the engine block of said engine.

The electromechanical device according to the present invention comprises a camshaft which comprises a sensor making it possible to provide information to the engine management system about the angular position of said camshaft.

The electromechanical device according to the present invention comprises a camshaft which comprises a return spring in rotation.

The electromechanical device according to the present invention comprises a camshaft which is connected to the electric motor by intermediate transmission means.

The electromechanical device according to the present invention comprises a camshaft which is positioned in the longitudinal axis of the control rod(s) of the control actuator (s) and perpendicular to said axis, and acts on the vertical position of said control rod(s) by means of at least one tappet.

The electromechanical device according to the present invention comprises a tappet which comprises a control device which makes it possible to fix the initial vertical position of at least one control rod relative to the initial vertical position of the other control rod(s) of the engine.

The electromechanical device according to the present invention comprises a control device, which the tappet comprises, which consists of a thread able to be immobilized in rotation.

The electromechanical device according to the present invention comprises a camshaft of which the position is offset relative to that of the control rod(s) of the control actuator(s), said camshaft making it possible to control the vertical position of said control rod(s) of the engine by means of at least one rocker arm.

The electromechanical device according to the present invention comprises a rocker arm which comprises a joint in the vicinity of its center permitting it to pivot relative to the engine, one of the ends of said rocker arm cooperating with at least one cam of the camshaft to control the angular position of said rocker arm, whilst the other end of said rocker arm cooperates with at least one control rod to control the vertical position of said control rod.

The electromechanical device according to the present invention comprises a rocker arm of which the joint located in the vicinity of its center permits said rocker arm to pivot relative to the engine, said joint comprising a control device which makes it possible to fix the initial vertical position of at least one control rod relative to the initial vertical position of the other control rod(s) of the engine.

The electromechanical device according to the present invention comprises a control device, which the joint made in the vicinity of the center of the rocker arm comprises, which consists of a thread which may be immobilized in rotation.

The electromechanical device according to the present invention comprises a rocker arm which comprises a joint at its end permitting it to pivot relative to the engine on the one hand, and a surface arranged in the vicinity of its center cooperating with at least one cam of the camshaft to control the angular position of said rocker arm, on the other hand, the other end of said rocker arm cooperating with at least one control rod to control the vertical position of said control rod.

The electromechanical device according to the present invention comprises a joint, which the rocker arm comprises at its end and which permits said rocker arm to pivot relative to the engine, which comprises a control device which makes it possible to fix the initial vertical position of at least one control rod relative to the initial vertical position of the other control rod(s) of the engine.

The electromechanical device according to the present invention comprises a control device which the joint made at the end of the rocker arm comprises, which consists of a thread which may be immobilized in rotation.

The electromechanical device according to the present invention comprises an electric motor which comprises a sensor making it possible to provide information to the engine management system about the angular position of said electric motor.

The electromechanical device according to the present invention comprises an engine which comprises as many electric motors as control rods, said control rods each having their own electric motor to control their vertical position.

The electromechanical device according to the present invention comprises mechanical means for transmitting the movement between at least one electric motor and at least one control rod which consist of at least one sprocket wheel shaft which comprises at least one sprocket wheel cooperating with a very small-sized rack mounted at the end of at least one control rod of the engine.

The electromechanical device according to the present invention comprises intermediate transmission means to connect the sprocket wheel shaft to the electric motor.

The electromechanical device according to the present invention comprises a very small-sized rack which comprises a control device which makes it possible to fix the initial vertical position of at least one control rod relative to the initial vertical position of the other control rod(s) of the engine.

The electromechanical device according to the present invention comprises a control device which the very small-sized rack comprises, which consists of a thread which may be immobilized in rotation.

The electromechanical device according to the present invention comprises a control rod which comprises two shoulders of small diameter which permit two valves of small diameter located respectively in the upper chamber and lower chamber of the control actuator to be raised, said control rod also comprising two shoulders of large diameter which permit two valves of large diameter also located respectively in the upper and lower chambers of the control actuator to be raised, said shoulders being positioned such that the valves of small diameter are always opened by the control rod before the valves of large diameter.

The electromechanical device according to the present invention comprises valves of small diameter which comprise at their center a bore penetrated by the control rod and a spherical contact zone which cooperates with a conical contact zone made in the valves of large diameter.

The electromechanical device according to the present invention comprises valves of small diameter which are kept in contact with the valves of large diameter housed in the same chamber by means of springs bearing against said valves of small diameter, on the one hand, and against the wall of the chamber of the control actuator in which they are housed, on the other hand, said springs also enabling the valves of large diameter to be kept in contact with the piston of the control actuator.

The electromechanical device according to the present invention comprises valves of small diameter which are kept in contact with the valves of large diameter housed in the same chamber by means of at least one spring fixed to the actuator piston and bearing against said valves of small diameter, said spring also enabling the valves of large diameter to be kept in contact with the piston of the control actuator.

The electromechanical device according to the present invention comprises valves of large diameter which comprise a smooth annular surface able to be kept in contact with a smooth surface made respectively on the upper and lower faces of the piston of the control actuator in order to create a seal with said piston.

The electromechanical device according to the present invention comprises valves of large diameter which comprise means which always keep said valves centered on the control rod according to their longitudinal axis.

The electromechanical device according to the present invention comprises at least one control rod of the engine which comprises at least one sensor making it possible to provide information to the engine management system about the vertical position of said rod.

The electromechanical device according to the present invention comprises at least one control rack of the engine which comprises at least one sensor making it possible to provide information to the engine management system about the vertical position of said rack.

The description which follows with reference to the accompanying drawings, given by way of non-limiting examples, will enable the invention to be more clearly understood, the features which it presents and the advantages which it is capable of achieving:

Figure 1:
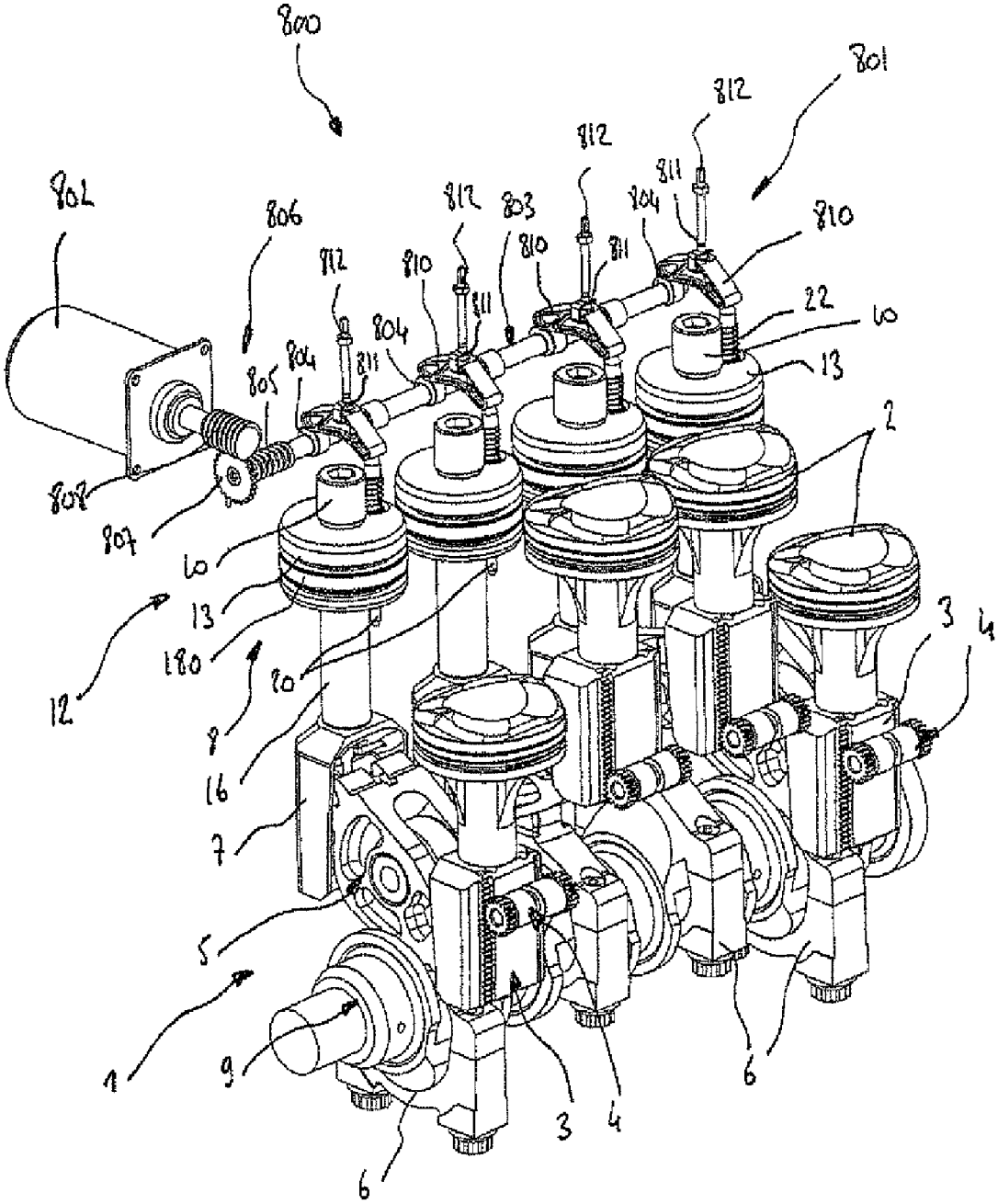
FIGS. 1 and 2 are perspective views illustrating an electromechanical device according to the present invention enabling the compression ratio of a variable compression ratio engine to be controlled.
Figure 2:
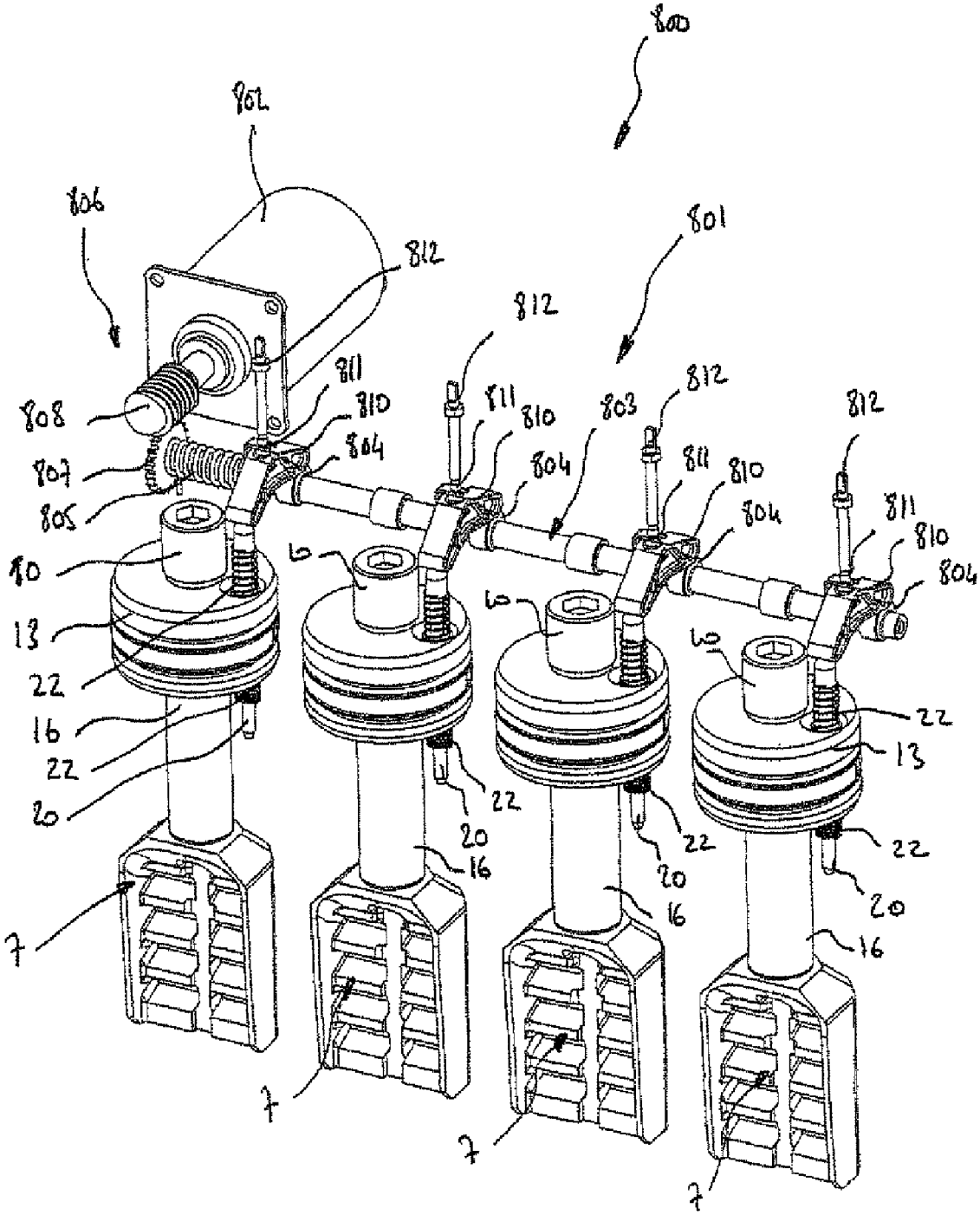

In FIGS. 1 and 2 an electromechanical device 800 is shown making it possible to control the compression ratio of a variable compression ratio engine comprising a transmission device 1 and a piston 2 for each cylinder.

The mechanical transmission device 1 comprises in the lower part of the piston 2, a transmission member 3 integral with said piston and cooperating, on the one hand, with a roller bearing guide device 4 and, on the other hand, with a sprocket wheel 5.

The sprocket wheel 5 cooperates with a connecting rod 6 connected to a crankshaft 9 in order to transmit the movement between the piston 2 and said crankshaft 9.

The sprocket wheel 5 cooperates opposite the transmission member 3 with a further rack known as a control rack 7 of which the vertical position is controlled relative to the engine block by a control device 12.

The control device 12 of the variable compression ratio engine comprises a control actuator 8 which consists of an upper actuator rod 10, a lower actuator rod 16, an actuator piston 13 and a control rod 20.

The electromechanical device 800 comprises mechanical means for transmitting the movement 801 between at least one electric motor 802 and at least one control rod 20 of a control device 12 making it possible to control the vertical position of the control rack 7 of said variable compression ratio engine.

The electric motor 802 may be, for example, a step motor, a servomotor or a linear motor.

The electromechanical device 800 comprises an electric motor 802 which comprises a sensor making it possible to provide information to the engine management system about the angular position of said electric motor.

The electromechanical device 800 comprises as many electric motors 802 as control rods 20, said control rods each having their own electric motor to control their vertical position.

The electromechanical device 800 comprises mechanical transmission means 801 which consist of at least one camshaft 803 which comprises at least one cam 804.

The camshaft 803 may be, for example, mounted on bearings or on rolling bearings, not shown.

The profile of the cam 804 of the camshaft 803 may be of any kind or even, for example, helical, in order to provide a constant ratio between the angular displacement of the camshaft 803 and the linear displacement of the member which is in contact with the cam.

The electromechanical device 800 may comprise a camshaft 803 which is positioned above the cylinder head of the control actuator(s) 8 of the control device 12 of the engine.

The electromechanical device 800 may comprise a camshaft 803 which is positioned below the control actuator(s) 8 of the control device 12 of the engine and inside the engine block of said engine.

The electromechanical device 800 may comprise a camshaft 803 which comprises a sensor making it possible to provide information to the engine management system about the angular position of said camshaft.

The electromechanical device 800 comprises a camshaft 803 which comprises a return spring 805 in rotation.

The spring 805 may be, for example, a torsion spring consisting of a wire wound in cylindrical shape or a helical spring consisting of sheet steel wound in a spiral.

The electromechanical device 800 comprises a camshaft 803 which is connected to the electric motor 802 by intermediate transmission means 806.

The intermediate transmission means 806 may consist, for example, of a sprocket wheel 807 which cooperates with an endless screw 808.

As a variant, the intermediate transmission means 806 may consist, for example, of a gear assembly comprising at least two sprocket wheels, or sprocket wheels connected to one another by a chain or by toothed pulleys connected to one another by a toothed belt.

Figure 4:
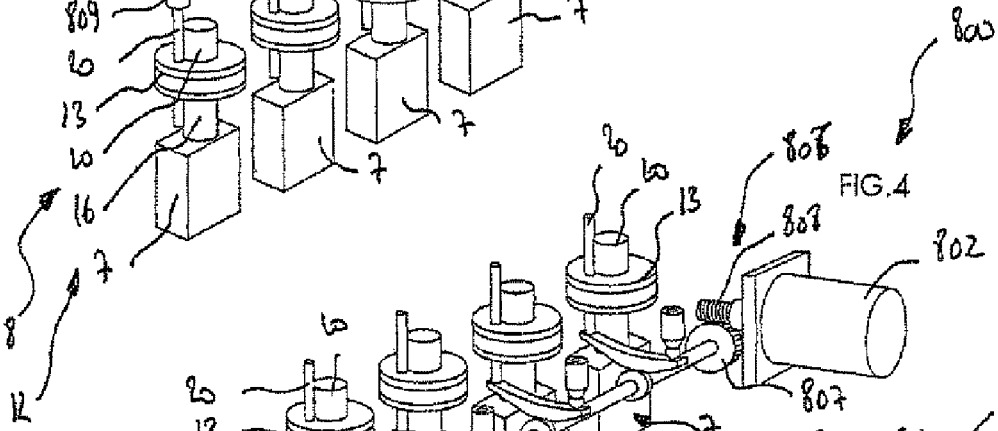
FIG. 4 is a schematic view illustrating a second variant of the electromechanical device according to the present invention.

In FIGS. 1, 2 and 4, the electromechanical device 800 according to the present invention is shown comprising a camshaft 803 of which the position is offset relative to that of the control rod(s) 20 of the control actuator(s) 8.

The camshaft 803 makes it possible to control the vertical position of said control rod(s) 20 of the engine by means of at least one rocker arm 810 and 813.

The rocker arm 810 and 813 may be made, for example, as a casting, in forged steel or pressed sheet metal.

Each rocker arm 810 comprises a joint 811 provided in the vicinity of its center enabling it to pivot relative to the engine.

One of the ends of the rocker arm 810 cooperates with at least one cam 804 of the camshaft 803 to control the angular position of said rocker arm, whilst the other end of said rocker arm cooperates with at least one control rod 20 to control the vertical position of said control rod.

It is noted that the joint 811 provided in the vicinity of the center of the rocker arm 810 may be, for example, a trunnion or a pivot pin.

Also, the joint 811, which each rocker arm 810 comprises in the vicinity of its center, comprises a control device 812 which makes it possible to fix the initial vertical position of at least one control rod 20 of a control actuator 8 relative to the initial vertical position of the other control rod(s) 20 of the other control actuator(s) 8 of the engine.

The control device 812, which the joint 811 made in the vicinity of the center of each rocker arm 810 comprises, consists of a thread which may be immobilized in rotation, for example by a counternut, by bonding, by wedging or by a brake of the "Nylstop" type.

Figure 3:
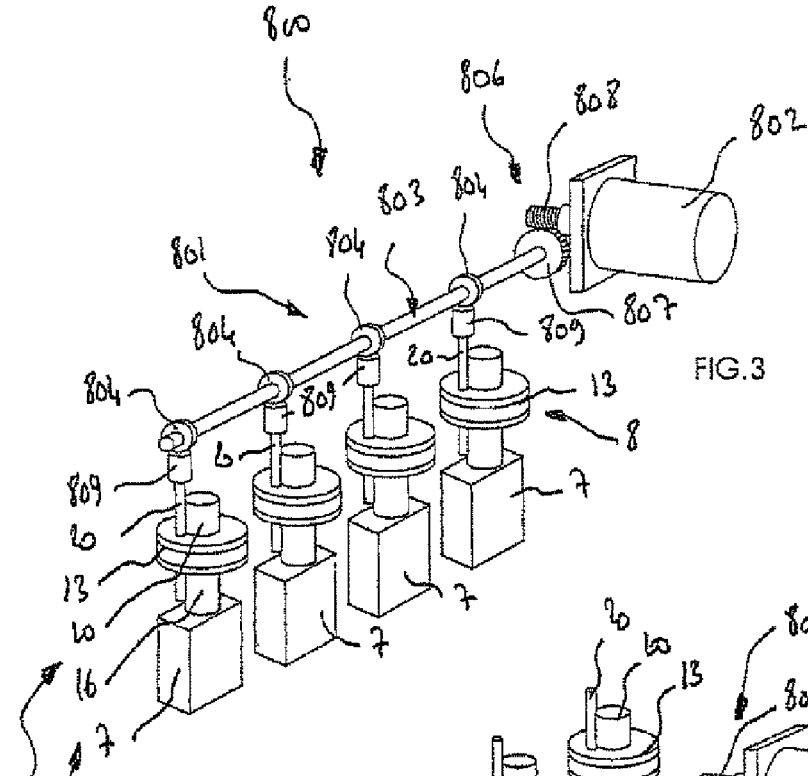
FIG. 3 is a schematic view showing a first variant of the electromechanical device according to the present invention.

In FIG. 3, the electromechanical device 800 according to the present invention is shown comprising a camshaft 803 which is positioned within the longitudinal axis of the control rod(s) 20 of the control actuator(s) 8 and perpendicular to said axis, and acts on the vertical position of said control rod(s) 20 by means of at least one tappet 809.

The tappet 809 comprises a control device which makes it possible to fix the initial vertical position of at least one control rod 20 relative to the initial vertical position of the other control rod(s) 20 of each control actuator 8 of the engine.

The control device, which the tappet comprises 809, consists of a thread able to be immobilized in rotation, for example, by a counternut, by bonding, by wedging or by a brake of the "Nylstop" type.

In FIG. 4 the electromechanical device 800 according to the present invention has been shown comprising a rocker arm 813 which comprises at one of its ends a joint 814 permitting it to pivot relative to the engine, on the one hand, and a surface 815 made in the vicinity of its center and cooperating with at least one cam 804 of the camshaft 803 to control the angular position of said rocker arm 813, on the other hand.

The other end of said rocker arm 813 is provided to cooperate with at least one control rod 20 of the control actuators 8 to control the vertical position of said control rod.

It is noted that the joint 814 which the rocker arm 813 comprises at its end may be, for example, a trunnion or a pivot pin.

The joint 814, which the rocker arm 813 comprises, at its end and which permits said rocker arm to pivot relative to the engine comprises a control device 816 making it possible to fix the initial vertical position of at least one control rod 20 relative to the initial vertical position of the other control rod(s) 20 of the engine.

The control device 816, which the joint 814 made at the end of the rocker arm 813 comprises, consists of a thread which may be immobilized in rotation, for example by a counternut, by bonding, by wedging or by a brake of the "Nylstop" type.

Figure 5:
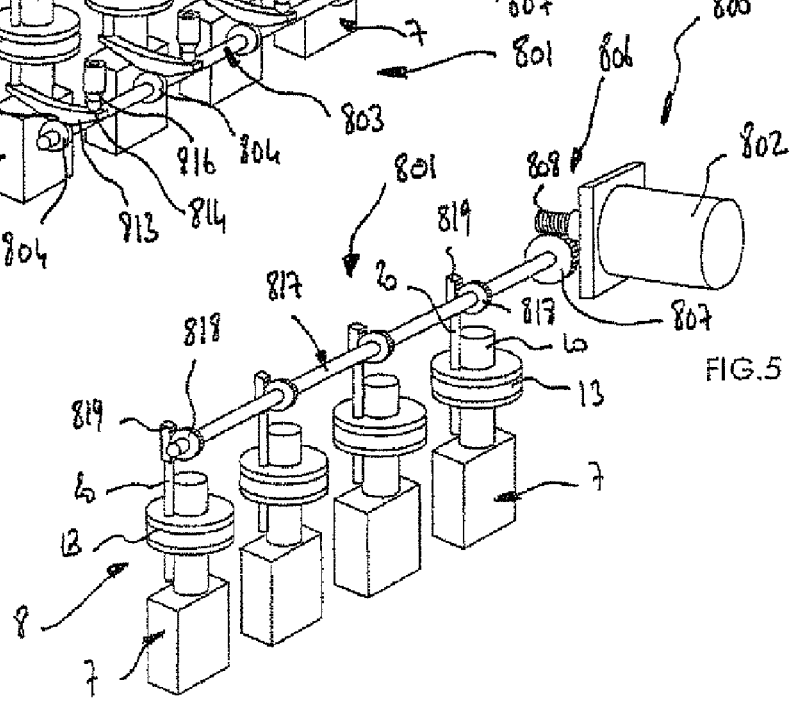
FIG. 5 is a schematic view showing a third variant of the electromechanical device according to the present invention.

In FIG. 5 the electromechanical device 800 according to the present invention has been illustrated comprising mechanical means for transmitting the movement 801 between at least one electric motor 802 and at least one control rod 20.

The mechanical means for transmitting the movement 801 consist of at least one sprocket wheel shaft 817 which comprises at least one sprocket wheel 818 cooperating with a very small-sized rack 819 mounted at the end of at least one control rod 20 of the engine.

The sprocket wheel shaft 817 may, for example, be mounted on bearings or on rolling bearings, not shown.

The sprocket wheel shaft 817 may, for example, be mounted on bearings or on rolling bearings, not shown.

The electromechanical device 800 comprises a sprocket wheel shaft 817 which is connected to the electric motor 802 by means of intermediate transmission means 806.

The intermediate transmission means 806 may consist, for example, of a sprocket wheel 807 which cooperates with an endless screw 808 or a gear assembly comprising at least two sprocket wheels, sprocket wheels connected to one another by a chain or toothed pulleys connected to one another by a toothed belt.

The very small-sized rack 819 comprises a control device making it possible to fix the initial vertical position of at least one control rod 20 relative to the initial vertical position of the other control rod(s) 20 of the engine.

The control device, which the very small-sized rack 819 comprises, consists of a thread, which may be immobilized in rotation, for example, by a counternut, by bonding, by wedging or by a brake of the "Nylstop" type.

When the electromechanical device 800 according to the present invention comprises either at least one tappet 809, or at least one rocker arm 810, 813, or at least one very small-sized rack 819, the control of the initial vertical position of the control rods 20 of the engine relative to one another is carried out during the assembly of the engine.

The control of the initial vertical position of the control rods 20 during the assembly of the engine is carried out either by measuring the height of the pistons 2 of the engine at top dead center by means of a comparator or by any other measuring instrument installed in the spark plug well or by measuring the volume of the combustion chambers of said engine when the pistons 2 of said engine are at top dead center.

According to a further embodiment, when the electromechanical device 800 cooperates with a tappet 809, or with a rocker arm 810, 813, or with a very small-sized rack 819, the device for controlling the initial vertical position of the control rods 20 of the engine relative to one another may consist of an electric motor. To this end, each electric motor may be, for example, a piezoelectric linear motor.

In this case, the control of the initial vertical position of the control rods 20 of the engine relative to one another may be carried out when the engine is in operation, either by measuring the effective pressure in the combustion chambers of the engine by means of appropriate sensors, or by deducting the effective pressure prevailing in the combustion chambers of the engine from the pressure measured in the upper chamber of the control actuators of the engine by means of at least one pressure sensor.

Figure 6:
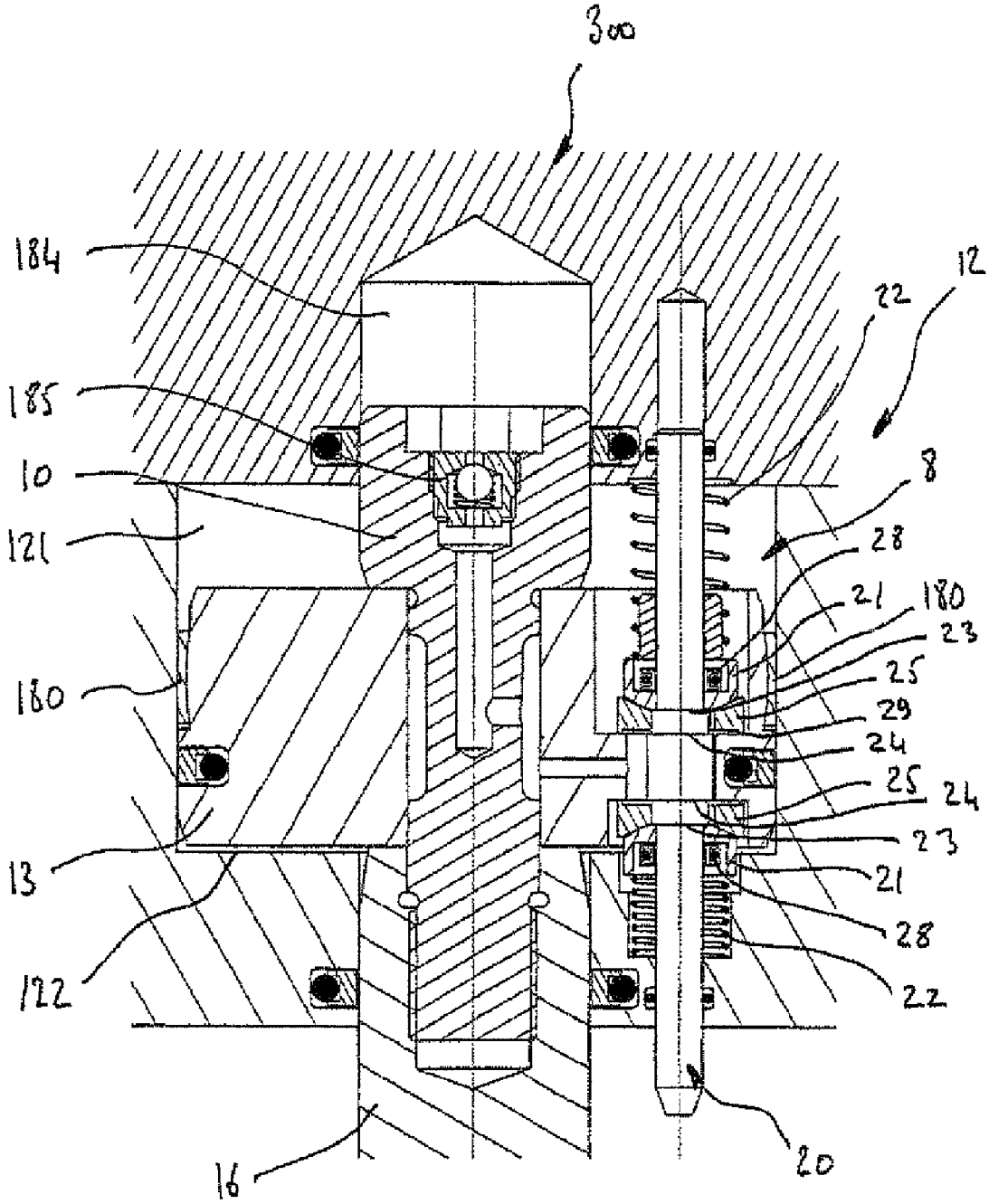
FIGS. 6 and 7 are views showing a control device of a variable compression ratio engine according to the present invention.
Figure 7:
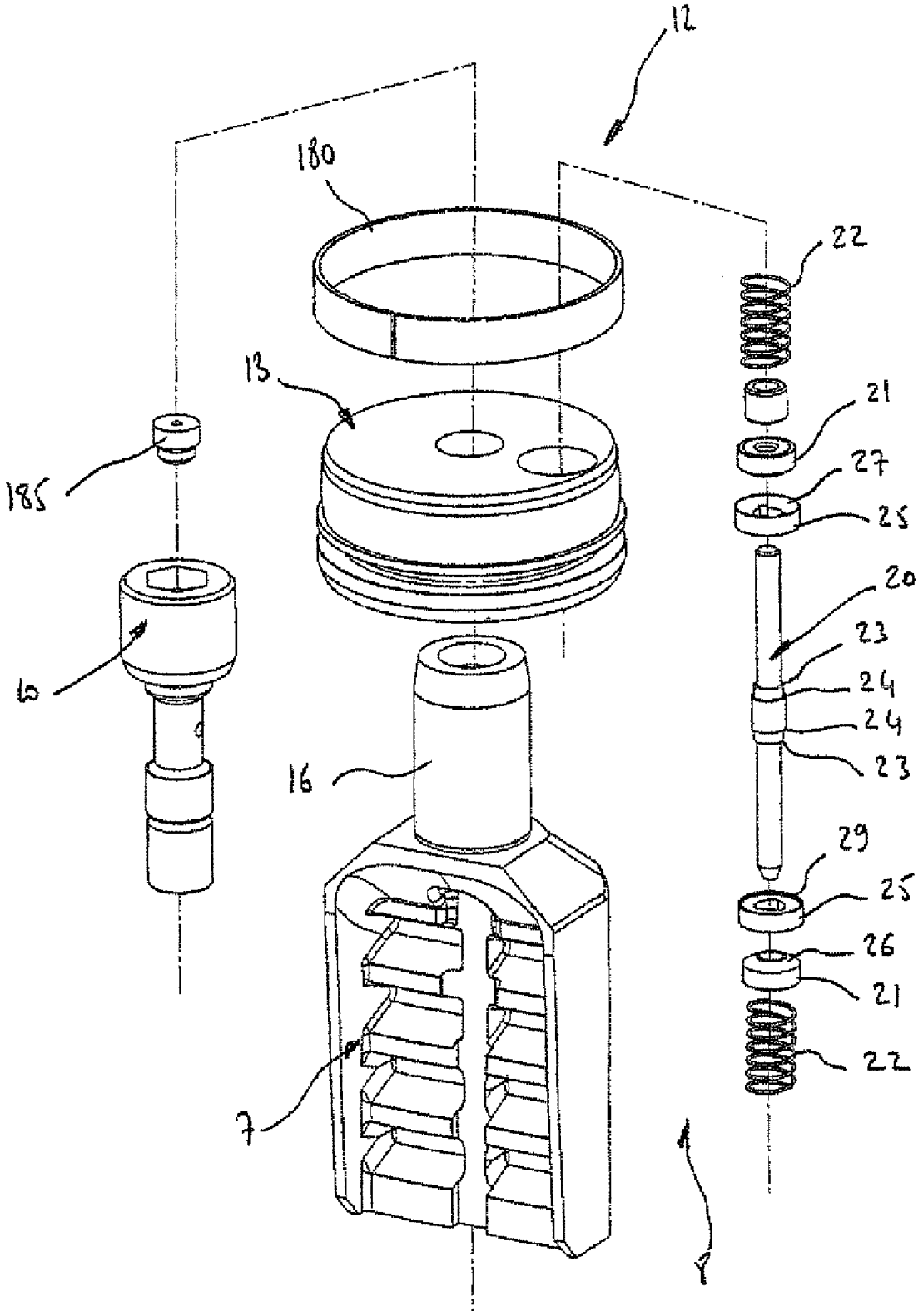

In FIGS. 6 and 7, a control device 12 of the variable compression ratio engine is shown comprising a control actuator 8 which consists of an upper actuator rod 10, a lower actuator rod 16, an actuator piston 13 and a control rod 20.

The actuator piston 13 comprises a peripheral swiveling ring 180 which follows the spherical shape of said piston actuator.

The upper actuator rod 10 comprises in its internal part and in its center a non-return valve 185 for compensating leaks, of which the inlet is in communication with a chamber 184 made in the cylinder head 300 of the control actuator 8.

The control rod 20 of the control actuator 8 of the electromechanical device 800 comprises two shoulders 23 of small diameter permitting two valves 21 of small diameter located respectively in the upper chamber 121 and lower chamber 122 of the control actuator 8 to be raised.

The control rod 20 also comprises two shoulders 24 of large diameter which permit two valves 25 of large diameter also located respectively in the upper chamber 121 and lower chamber 122 of the control actuator 8 to be raised.

The shoulders 23 of small diameter and the shoulders 24 of large diameter are positioned such that the valves of small diameter 21 are always opened by the control rod 20 before the valves 25 of large diameter.

The valves 21 of small diameter comprise at their center a bore penetrated by the control rod 20, and a spherical contact zone 26 which cooperates with a conical contact zone 27 made in the valves 25 of large diameter.

According to a particular embodiment, the bore made in the center of the valves 21 of small diameter and which is penetrated by the control rod 20 may comprise a groove containing a gasket 28 able to be toroidal and made of elastic material, or in two parts, one part which is annular and directly in contact with the control rod 20 and which has particular features of resistance against wear, and the other part which is toroidal having particular features of elasticity and sealing and which always remains in contact with the base of said groove.

To this end, to facilitate the mounting of the gasket 28, the valves 21 of small diameter may be made in two parts which are mounted by shrinking on, bonding or crimping after mounting the gasket.

The valves 21 of small diameter are maintained in contact with the valves 25 of large diameter housed in the same chamber by means of springs 22 bearing against said valves 21 of small diameter, on the one hand, and on the wall of the chamber 121, 122 of the control actuator 8 in which they are housed, on the other hand, said springs 22 also permitting the valves 25 of large diameter to be kept in contact with the piston of the actuator 13 of the control actuator 8.

According to one particular embodiment, the springs 22 may be, for example, of helicoidal type and may be mounted coaxially to the control rod 20.

As a variant, the valves 21 of small diameter are kept in contact with the valves 25 of large diameter housed in the same chamber 121, 122 by means of at least one spring fixed to the actuator piston 13 and bearing against said valves of small diameter, said spring also permitting the valves 25 of large diameter to be kept in contact with the actuator piston 13 of the control actuator 8.

According to one particular embodiment, the spring fixed to the actuator piston 13 may consist of a steel sheet of appropriate shape or may be a torsion spring consisting of a steel wire winding.

The valves 25 of large diameter comprise a smooth annular surface 29 able to be maintained in contact with a smooth surface made respectively on the upper and lower faces of the piston of the actuator 13 of the control actuator 8 in order to create a seal with said piston.

The valves 25 of large diameter comprise centering means which always keeps said valves centered on the control rod 20 according to their longitudinal axis.

According to one particular embodiment, the centering means which ensure the centering of the valves of large diameter on the control rod 20 allow sufficient radial mobility for said valves 25 of large diameter so that the seal between said valves and the piston of the actuator 13 of the control actuator 8 is always implemented whatever the orientation of said piston relative to the engine.

The electromechanical device 800 comprises at least one control rod 20 which comprises at least one sensor making it possible to provide information to the engine management system about the vertical position of said rod.

The electromechanical device 800 comprises at least one control rack 7 which comprises at least one sensor making it possible to provide information to the engine management system about the vertical position of said rack.

It has to be understood, moreover, that the above description has only been provided by way of example and that it in no way limits the scope of the invention from which one would not depart by replacing the details of the embodiments described by any other equivalent.

The invention claimed is:

1. An electromechanical device permitting the compression ratio of a variable compression ratio engine to be controlled, wherein comprising:

at least one transmission device (1) permitting the transmission of the movement to each piston (2) by means of a transmission member (3) integral with said piston and cooperating, on the one hand, with a roller bearing guide device (4);

a sprocket wheel (5) mounted on a connecting rod (6) integral with a crankshaft (9) and with a control rack (7) cooperating opposite the transmission member (3) with the sprocket wheel (5) and at least one control device (12), said control device (12) comprising, a control actuator (8) which includes an actuator piston (13) integral with an upper actuator rod (10) and with a lower actuator rod (16) cooperating with said control rack (7), and a control rod (20) passing through the actuator piston (13) in order to control the vertical position of said control rack (7) relative to the engine block of said engine; and mechanical means for transmitting the movement (801) which includes a shaft (803) comprising at least one cam (804), wherein said mechanical means for transmitting the movement (801) between at least one electric motor (802) and the at least one control rod (20) of the control actuator (8) of a control device (12) configured to control the vertical position of a control rack (7) of said variable compression ratio engine.

2. The electromechanical device as claimed in claim 1, wherein the camshaft (803) is positioned above the cylinder head (300) of the control actuator(s) (8) of the engine.

3. The electromechanical device as claimed in claim 1, wherein the camshaft (803) is positioned below the control actuator(s) (8) of the engine, inside the engine block of said engine.

4. The electromechanical device as claimed in claim 1, wherein the camshaft (803) comprises a sensor configured to provide information to the engine management system about the angular position of said camshaft.

5. The electromechanical device as claimed in claim 1, wherein the camshaft (803) comprises a return spring (805) in rotation.

6. The electromechanical device as claimed in claim 1, wherein the camshaft (803) is connected to the electric motor (802) by intermediate transmission means (806).

7. The electromechanical device as claimed in claim 1, wherein the camshaft (803) is positioned in the longitudinal axis of the control rod(s) (20) of the control actuator(s) (8) and perpendicular to said axis, and acts on the vertical position of said control rod(s) (20) by means of at least one tappet (809).

8. The electromechanical device as claimed in claim 7, wherein the tappet (809) comprises a control device configured to fix the initial vertical position of at least one control rod (20) relative to the initial vertical position of the other control rod(s) (20) of the engine.

9. The electromechanical device as claimed in claim 8, wherein the control device, which the tappet (809) comprises, includes a thread able to be immobilized in rotation.

10. The electromechanical device as claimed in claim 1, wherein the position of the camshaft (803) is offset relative to that of the control rod(s) (20) of the control actuator(s) (8), said camshaft (803) configured to control the vertical position of said control rod(s) (20) of the engine by means of at least one rocker arm (810, 813).

11. The electromechanical device as claimed in claim 10, wherein the rocker arm (810) comprises a joint (811) in the vicinity of its center permitting it to pivot relative to the engine, one of the ends of said rocker arm cooperating with at least one cam (804) of the camshaft (803) to control the angular position of said rocker arm, whilst the other end of said rocker arm (810) cooperates with at least one control rod (20) to control the vertical position of said control rod.

12. The electromechanical device as claimed in claim 11, wherein the joint (811), which the rocker arm (810) comprises in the vicinity of its center and which permits said rocker arm to pivot relative to the engine, comprises a control device (812) configured to fix the initial vertical position of at least one control rod (20) relative to the initial vertical position of the other control rod(s) (20) of the engine.

13. The electromechanical device as claimed in claim 12, wherein the control device (812), which the joint (811) arranged in the vicinity of the center of the rocker arm (810) comprises, includes a thread which may be immobilized in rotation.

14. The electromechanical device as claimed in claim 10, wherein the rocker arm (813) comprises a joint (814) at its end permitting it to pivot relative to the engine, on the one hand, and a surface (815) arranged in the vicinity of its center cooperating with at least one cam (804) of the camshaft (803) to control the angular position of said rocker arm, on the other hand, the other end of said rocker arm (813) cooperating with at least one control rod (20) to control the vertical position of said control rod.

15. The electromechanical device as claimed in claim 14, wherein the joint (814), which the rocker arm (813) comprises at its end and permitting said rocker arm to pivot relative to the engine, comprises a control device (816) configured to fix the initial vertical position of at least one control rod (20) relative to the initial vertical position of the other control rod(s) (20) of the engine.

16. The electromechanical device as claimed in claim 15, wherein the control device (816) which the joint (814) made at the end of the rocker arm (813) comprises, includes a thread which may be immobilized in rotation.

17. The electromechanical device as claimed in claim 1, wherein the mechanical means for transmitting the movement (806) between at least one electric motor (802) and at least one control rod (20) includes at least one sprocket wheel shaft (817) which comprises at least one sprocket wheel (818) cooperating with a very small-sized rack (819) mounted at the end of at least one control rod (20) of the engine.

18. The electromechanical device as claimed in claim 17, wherein intermediate transmission means (801) configured to connect the sprocket wheel shaft (817) to the electric motor (802).

19. The electromechanical device as claimed in claim 17, wherein the very small-sized rack (819) comprises a control device configured to fix the initial vertical position of at least one control rod (20) relative to the initial vertical position of the other control rod(s) (20) of the engine.

20. The electromechanical device as claimed in claim 19, wherein the control device, which the very small-sized rack (819) comprises, includes a thread which may be immobilized in rotation.

21. The electromechanical device as claimed in claim 1, wherein the electric motor (802) comprises a sensor configured to provide information to the engine management system about the angular position of said electric motor.

22. The electromechanical device as claimed in claim 1, wherein it comprises as many electric motors as control rods (20), said control rods (20) each having their own electric motor to control their vertical position.

23. The electromechanical device as claimed in claim 1, wherein the control rod (20) comprises two shoulders (23) of small diameter which permit two valves (21) of small diameter located respectively in the upper chamber (121) and lower chamber (122) of the control actuator (8) to be raised, said control rod (20) also comprising two further shoulders (24) of large diameter which permit two further valves (25) of large diameter also located respectively in the upper chamber (121) and lower chamber (122) of the control actuator (8) to be raised, said shoulders being positioned such that the valves (21) of small diameter are always opened by the control rod (20) before the valves (25) of large diameter.

24. The electromechanical device as claimed in claim 23, wherein the valves (21) of small diameter comprise at their center a bore penetrated by the control rod (20) and a spherical contact zone (26) which cooperates with a conical contact zone (27) made in the valves (25) of large diameter.

25. The electromechanical device as claimed in claim 23, wherein the valves (21) of small diameter are kept in contact with the valves (25) of large diameter housed in the same chamber (121, 122) by means of springs (22) bearing against said valves of small diameter, on the one hand, and against the wall of the chamber (121, 122) of the control actuator (8) in which they are housed, on the other hand, said springs (22) also enabling the valves (25) of large diameter to be kept in contact with a piston of the actuator (13) of the control actuator (8).

26. The electromechanical device as claimed in claim 23, wherein the valves (21) of small diameter are kept in contact with the valves (25) of large diameter housed in the same chamber (121, 122) by means of at least one spring fixed to an actuator piston (13) of the control actuator (8) and bearing against said valves of small diameter, said spring also enabling the valves of large diameter to be kept in contact with the actuator piston (13) of the control actuator (8).

27. The electromechanical device as claimed in claim 23, wherein the valves (25) of large diameter comprise a smooth annular surface (29) able to be kept in contact with a smooth surface made respectively on the upper and lower faces of the actuator piston (13) of the control actuator (8) in order to create a seal with said piston.

28. The electromechanical device as claimed in claim 23, wherein the valves (25) of large diameter comprise centering means which always keep said valves centered on the control rod according to their longitudinal axis.

29. The electromechanical device as claimed in claim 1, wherein at least one of the control rods (20) of a control actuator (8) comprises at least one sensor configured to provide information to the engine management system about the vertical position of said control rod (20).

30. The electromechanical device as claimed in claim 1, wherein at least one of the control racks (7) comprises at least one sensor configured to provide information to the engine management system about the vertical position of said rack.

* * * * *